US006148462A

United States Patent [19]

Zseng

[11] Patent Number: 6,148,462

[45] Date of Patent: Nov. 21, 2000

[54] STRUCTURE OF A MULTIFUNCTIONAL TOOTH-BRUSH

[76] Inventor: Chun-Lin Zseng, P.O. Box 82-144, Taipei, Taiwan

[21] Appl. No.: 09/361,417

[22] Filed: Jul. 27, 1999

[51] Int. Cl.[7] ..... A46B 13/00

[52] U.S. Cl. ..... 15/22.1; 15/4; 15/28

[58] Field of Search ..... 15/4, 22.1, 23, 15/25, 26, 28

[56] References Cited

U.S. PATENT DOCUMENTS 2,660,745 12/1953 Yusko ..... 15/22.1
4,783,869 11/1988 Lee ..... 15/22.1

FOREIGN PATENT DOCUMENTS 715040 11/1931 France ..... 15/22.1
2551960 3/1985 France ..... 15/22.1

*Primary Examiner*—Mark Spisich
*Attorney, Agent, or Firm*—A & J

[57] ABSTRACT

The present relates to an improved structure of a multifunctional tooth-brush comprising a handle body, a bristles seat, an actuating rod, a teeth-polishing disc, a positioning peg and a spring. The bristles mounted on the bristles seat brushes the teeth when the tooth-brush is applied to the teeth in horizontal direction. The polishing disc mounted on the bristles seat polishes the teeth during the process of brushing the teeth.

1 Claim, 4 Drawing Sheets

STRUCTURE OF A MULTIFUNCTIONAL TOOTH-BRUSH

BACKGROUND OF THE INVENTION a) Technical Field of the Invention

The present invention relates to a tooth-brush, and in particular, to a multifunctional tooth-brush which does not employ any electric current supply to provide brushing and polishing of teeth.

b) Description of the Prior Art

The present invention is an improvement of the granted ROC Utility Model patent application no. 8621 4621 entitled "manually rotatable tooth-brush structure", Utility Model patent number 132017. The drawbacks of the granted patent are summarized as follows:

(i) When the brush is applied horizontally to brush the teeth, the head portion of the brush is caused to circulate in accordance with the circular movement of the brush handle. The bristles of the brush mounted in horizontal along the brush head are moved in horizontal, and therefore, circular movement and up and down movement of the brush causes a resistance to the teeth which in turn cause the handle to rotate but the brush head remains stationary.

(ii) A second drawback is that the brush head is made to move up and down, and at the same time, it has to be retracted into the inner hole of the handle. Thus, their frictional force with the teeth is great.

(iii) The brush only provides a horizontal brushing and at the same time an up and down direction brushing of the teeth. The brush does not provide a teeth-polishing function.

SUMMARY OF THE INVENTION

Accordingly, it is an object of the present invention to provide a multifunctional toothbrush comprising (a) a handle body having an elongated top covering and a bottom covering enclosing a hollow space, the edge of the bottom covering being provided with a plurality of engaging dovetail joints in combination with a plurality of mounting holes on the edge of the top covering, the enclosed hollow space constituted elongated slot, a curving slot and a spring chamber and a partition wall having a notch being formed in between the spring chamber and the curving slot, the surface of the top covering, at the position corresponding to the spring chamber, being provided with a plurality of water-discharging holes 116; (b) a bristles seat 2, having a top housing seat 22 and a bottom housing seat, the housing seats, individually having a head portion and an extension portion, a plurality of dovetail joints being provided on the top surface of the bottom housing seat to combine with a plurality of mounting holes on the bottom surface of the top housing seat, a plurality of fixed bristles being mounted on the top surface of the surface of the top housing seat along the edge thereof, a circular hole and a rectangular opening being provided adjacent to each other on the surface of the top housing seat, wherein the top end of the bottom housing seat is provided with a peg mounting hole in alignment with the circular hole at the head portion of the top housing seat, and a cylindrical recess is in alignment with the rectangular opening on the top housing seat, at one edge of the cylindrical recess, adjacent to the extension portion, a semi-circular slot is provided, and along the extension portion, an elongated semi-circular slot is extended until the end section thereof; (c) an actuating rod being an elongated rod having a small shaft having a protrusion mounted vertically to the small shaft at the top end thereof, a cylindrical shaft of larger diameter being mounted vertically with a row of bristles, and a vertical cross-shaped member being provided onto the rod, close to the rear end of the actuating rod, and the rear end of the rod being provided with a circular blocking disc; (d) a teeth-polishing disc having a plurality of tiny particle on the surface thereof, and the center, at the bottom surface, of the disc being provided with a polygonal hole with a plurality of vertical slots at the external edge; (e) a positioning peg having the head portion being fabricated into a polygonal head; and (f) a spring located within the cylindrical spring chamber.

Thereby, while brushing the teeth, the hand holds the handle and when the handle is pushed towards the bristles seat, the cross-shaped member on the actuating rod moves along the curving slot, which cause the protrusion at the top of the actuating rod to move simultaneous with the movement of the actuating rod and drives the polishing disc, and when the bristles seat and the actuating rod retract back into the handle until the blocking disc compresses the spring, the spring force of the spring cause the actuating rod and the cross-shaped member to move towards the bristles seat along the curving slot again, thus, the polishing disc rotates to polish the teeth.

Yet another object of the present invention is to provide a multifunctional toothbrush, wherein the up-and-down movement of the brush and the rotating of the polishing disc are achieved in accordance with the speed of the brushing.

Another object of the present invention is to provide a multifunctional tooth-brush, wherein the polishing disc can polishing the plaque on the teeth while brushing the teeth.

Yet a further object of the present invention is to provide a multifunctional tooth brush, wherein no current or batteries is needed in brushing or polishing the teeth.

BRIEF DESCRIPTION OF THE DRAWINGS

The present invention will be more particularly described with reference to the accompanying drawings, in which.

DETAILED DESCRIPTION OF THE PREFERRED EMBODIMENT

Figures 1A, 1B:
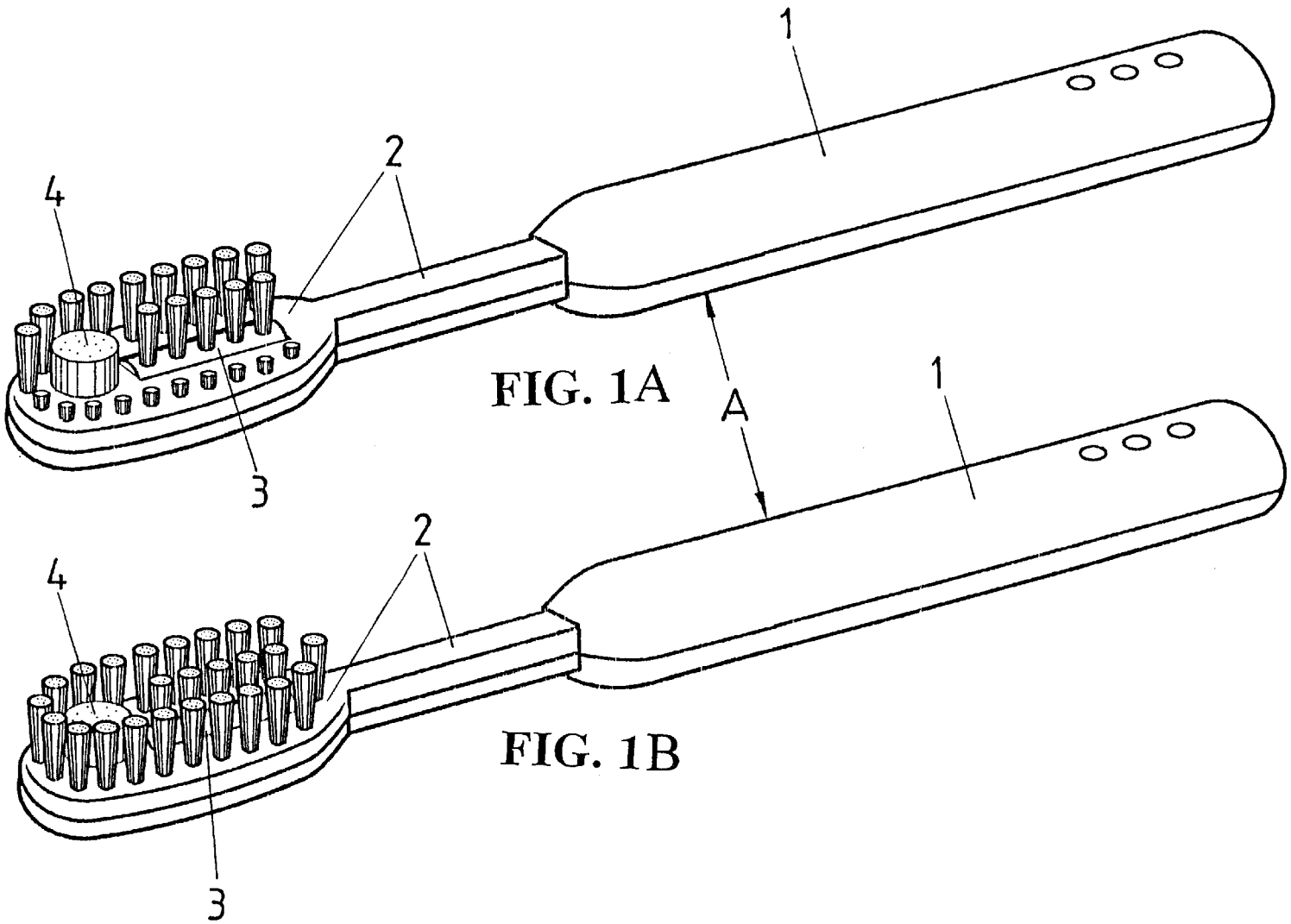
FIG. 1A is a perspective view of the multifunctional tooth-brush of the present invention, wherein partial bristles are removed.
FIG. 1B illustrates a complete tooth-brush according to the present invention.
Figure 2:
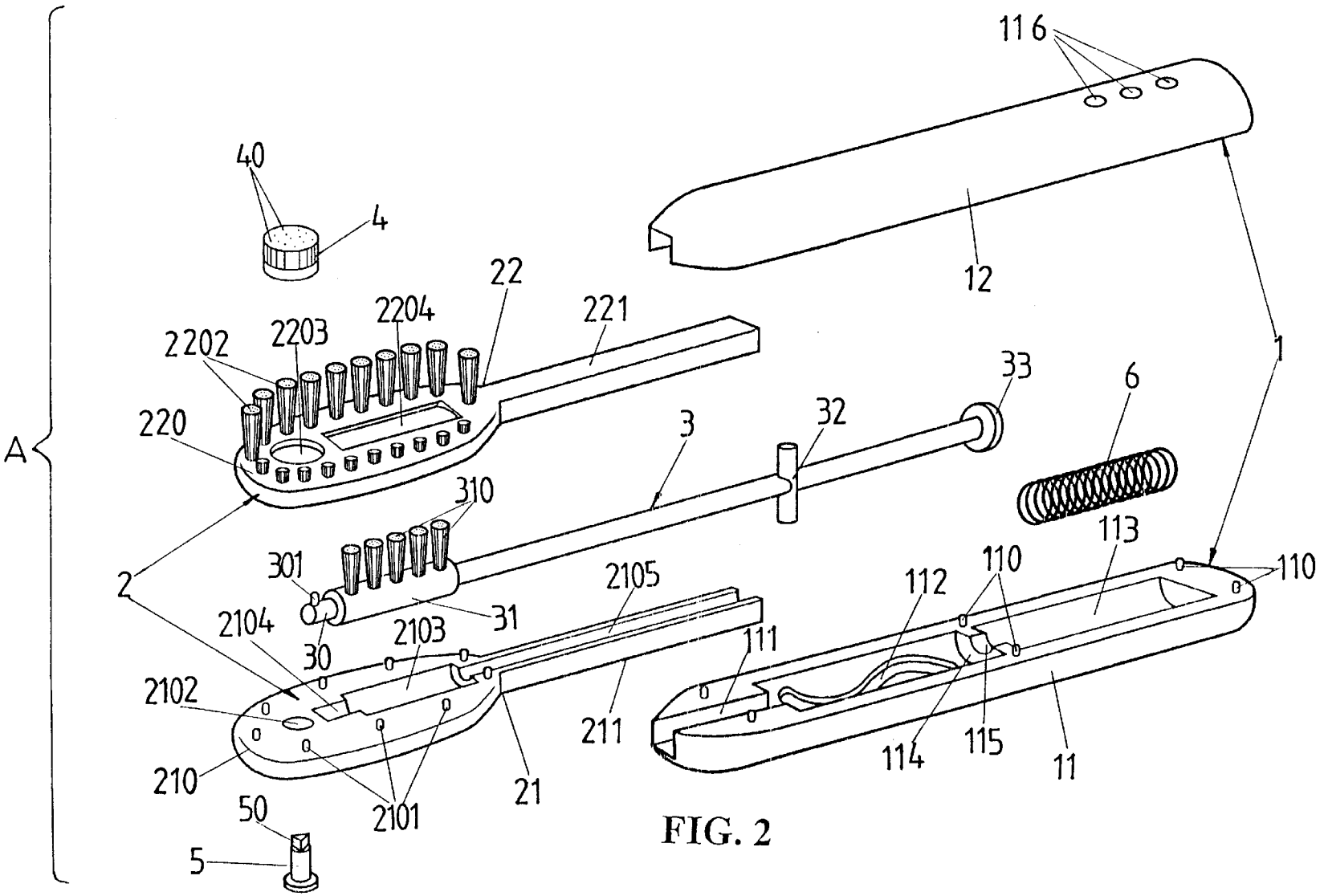
FIG. 2 is a perspective exploded view of the multifunctional tooth-brush of the present invention.
Figure 3:
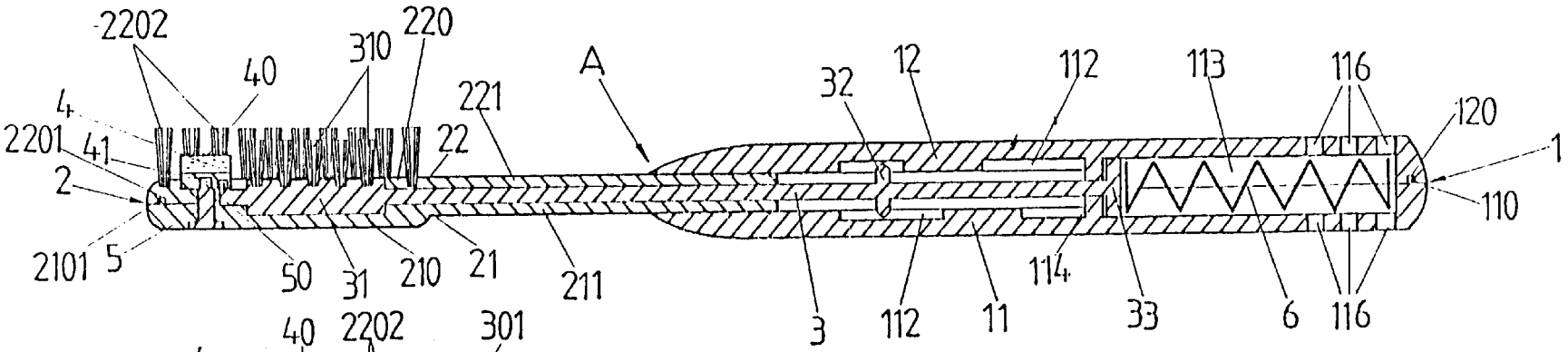
FIG. 3 is a sectional view of the multifunctional tooth-brush of the present invention.

Referring to FIGS. 1A, 1B, 2 and 3, there is shown the multifunctional toothbrush of the present invention. The toothbrush comprises (a) a handle body 1 having an elongated top covering 12 and a bottom covering 11 enclosing a hollow space, the edge of the bottom covering 12 being provided with a plurality of engaging dovetail joints 110 in combination with a plurality of mounting holes 120 on the edge of the top covering, the enclosed hollow space constituted an elongated slot 111, a curving slot 112 and a spring chamber 113 and a partition wall having a notch 115 being formed in between the spring chamber 113 and the curving slot 112, the surface of the top covering, at the position corresponding to the spring chamber 113, being provided with a plurality of water-discharging holes 116; (b) a bristles seat 2, having a top housing seat 22 and a bottom housing seat 21, the housing seats 21, 22 individually having a head portion 210, 220 and an extension portion 211, 221, a plurality of dovetail joints 2101 being provided on the top surface of the bottom housing seat 21 to combine with a plurality of mounting holes 2201 on the bottom surface of the top housing seat 22, a plurality of fixed bristles 2202 being mounted on the top surface of the surface of the top housing seat 22 along the edge thereof, a circular hole 2203 and a rectangular opening 2204 being provided adjacent to each other on the surface of the top housing seat 22, wherein the top end of the bottom housing seat 21 is provided with a peg mounting hole 2102 in alignment with the circular hole 2203 at the head portion 220 of the top housing seat 22, and a cylindrical recess 2103 is in alignment with the rectangular opening 2204 on the top housing seat 22, at one edge of the cylindrical recess 2103, adjacent to the extension portion 211, a semi-circular slot 2104 is provided, and along the extension portion 211, an elongated semi-circular slot 2105 is extended until the end section thereof; (c) an actuating rod 3 being an elongated rod having a small shaft 30 having a protrusion 301 mounted vertically to the small shaft at the top end thereof, a cylindrical shaft 31 of larger diameter being mounted vertically with a row of bristles 310, and a vertical cross-shaped member 32 being provided onto the rod 3, close to the rear end of the actuating rod, and the rear end of the rod 3 being provided with a circular blocking disc 33; (d) a teeth-polishing disc 4 having a plurality of tiny particle 40 on the surface thereof, and the center, at the bottom surface, of the disc 4 being provided with a polygonal hole 41 with a plurality of vertical slots 42 at the external edge; (e) a positioning peg 5 having the head portion being fabricated into a polygonal head 50; and (f) a spring 6 located within the cylindrical spring chamber 113.

Thereby, while brushing the teeth, the hand holds the handle 1 and when the handle 1 is pushed towards the bristles seat 2, the cross-shaped member 32 on the actuating rod 3 moves along the curving slot 112, which cause the protrusion 301 at the top of the actuating rod 3 to move simultaneous with the movement of the actuating rod 3 and drives the polishing disc 4, and when the bristles seat 2 and the actuating rod 3 retract back into the handle 1 until the blocking disc 33 compresses the spring 6, the spring force of the spring 6 cause the actuating rod 3 and the cross-shaped member 32 to move towards the bristles seat 2 along the curving slot 112 again, thus, the polishing disc 4 rotates to polish the teeth.

Figure 5:
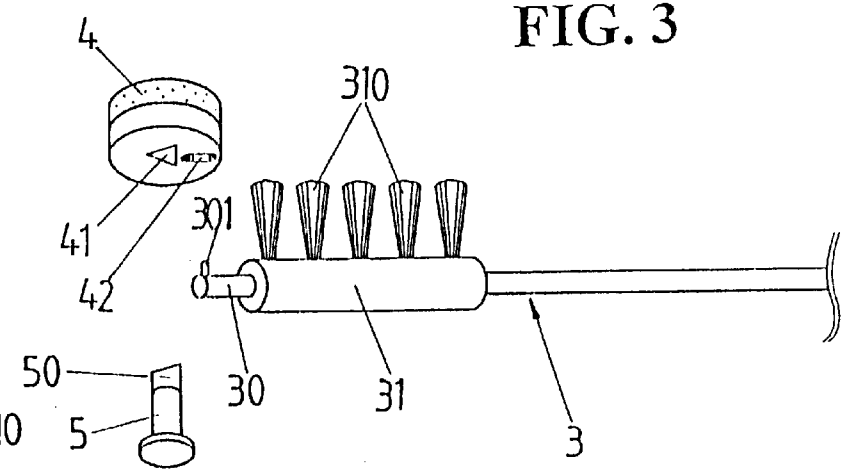
FIG. 5 is a perspective view of the actuating rod, the polishing disc, and the mounting peg, of the tooth-brush of the present invention.
Figure 4:
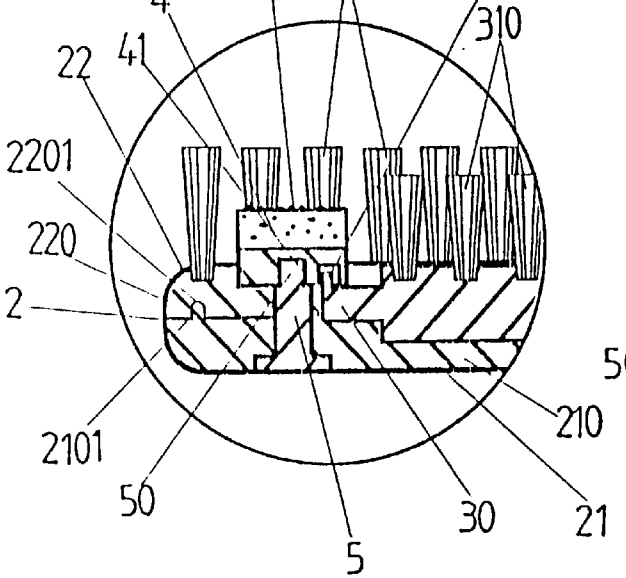
FIG. 4 is an enlarged sectional view of the bristles of the tooth-brush of the present invention.

In accordance with the present invention, the circular polishing disc 4 is inserted into the circular hole 2203 on the housing seat 22 of the bristles seat 2. The cylindrical slot 2204 is adapted for the bristles 310 at the front end of the larger diameter shaft 31 of the actuating rod 3, and the protrusion 301 at the tip of the small diameter shaft 30 of the actuating rod 3 is mounted at the vertical slot 42 directly below the polishing disc 4 (as shown in FIGS. 4 and 5). Further the actuating rod 3 is placed at the cylindrical slot on the extension portion 221 of the top housing seat 22. The top housing seat 22 and the bottom housing seat 21 are combined or secured together by means of the dovetail joints 2101 and the mounting hole 2201 respectively provided on the bottom housing seat 21 and the top housing seat 22, and the actuating rod 3 is enclosed within the top and bottom housing seats 21, 22. A positioning peg 5 is inserted into the peg mounting hole 2102 from the bottom housing seat 21 such that the polygonal head 50 of the peg 5 is engaged with the polygonal hole 41 provided below the polishing disc 4 (as shown in FIG. 4). After that, the bristles seat 2 and the actuating rod 3 are combined and is placed on the elongated slot 111 of the bottom housing seat 11 of the handle 1, and the bottom end of the cross-shaped member 32 is first placed into the curving slot 112 of the bottom housing seat 11, and then position the blocking disc 33 and the end of the actuating rod 3. A spring 6 is inserted into the spring chamber 113. Finally, by aligning the mounting hole 120 with the dovetail joint of the bottom housing seat 11, the top covering 12 and the bottom covering 11 are combined together to form a novel tooth-brush.

The tooth-brush, according to the present invention, can be used to brush the teeth and to polish the teeth simultaneously.

In accordance with the present invention, when the tooth-brush is used in brushing the teeth, the brush is held at the handle 1 and the bristles seat 2, which is retractable, is pushed horizontally and drives the actuating rod 3 with the mounted cross-shaped member 32 to slide along the curving slot 112 within the handle 1 simultaneously so that the actuating rod 3 moves in a radial direction. At this instant, the actuating rod 3 links with the protrusion 301 of the small diameter shaft 30, and in turn, drives the polishing disc 4.

When the bristles seat 2 and the actuating rod 3 altogether retract into the handle 1, the blocking disc 33 urges the spring 6 until it is being compressed. Then the brush moves backward, the spring force of spring 6 is released and urges the actuating rod 3 and the interlinked bristle seat 2, such that the cross-shaped member 32 moves in a reverse direction along the curving slot 112, which causes the polishing disc 4 to swing in an opposite direction to the forward movement of the brush. Thus, the brush brushes the teeth and at the same time, the teeth are polished.

Figure 6:
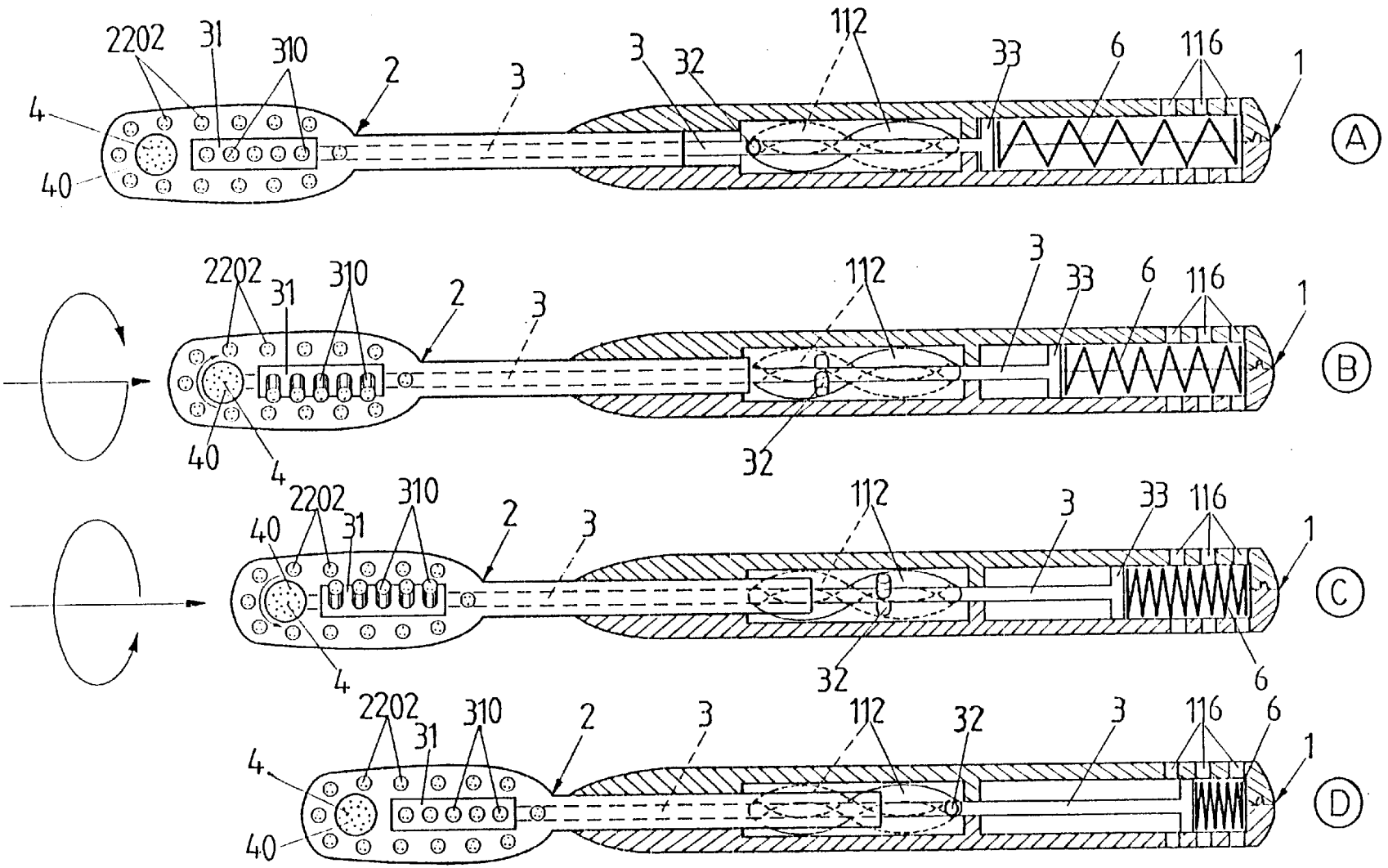
FIG. 6 shows the top views of the tooth brush of the present invention.

FIG. 6 shows the top sectional views of the tooth-brush of the present invention at different condition of implementation. As shown in FIG. 6A, the brush body has not being urged by a force. That is, the combination of the bristle seat 2 and the actuating rod 3 does not compress the spring 6. FIG. 6B shows the tooth-brush is used to brush teeth by moving the brush body forwards. Thus, the extension portion 211, 221 at one end of the bristle seat 2 moves towards the elongated slot 111 of the handle 1 and drives the actuating rod 3. The cross-shaped member 32 on the actuating rod 3 moves along the curving slot 112 such that the bristle 310 moves up and down. At this moment the protrusion 301 at the small diameter shaft 30 of the actuating rod 3 causes the polishing disc 4 to rotate (turn). When the brush is pushed further (as shown in FIG. 6C), the cross-shaped member 32 moves further along the curving slot 112, and the bristle 310 on the actuating rod 3 moves downward, and at the same time the protrusion 301 simultaneously causes the polishing disc 4 to turn in a direction opposite to the previous turning. When the cross-shaped member 32 slides to the end of the curving slot 112, the blocking disc 33 at the end of the actuating rod 3 urges the spring 6 until it is being compressed (as shown in FIG. 6D). At this moment, the spring force of the spring 6 will be released, and the bristle seat 2 and the actuating rod 3 urge the handle 1, which simultaneously cause the bristle 310 to brush in an up and down direction, until the protrusion 301 drives the polishing disc 4 back to its original position. This forward-backward teeth-brushing by the fixed bristle 2202 on the bristle seat 2 allows the bristle 310 and the polishing disc 4 to simultaneously clean the plaque on the teeth and the crevice between the teeth.

While the invention has been particularly shown and described with reference to the preferred embodiment, it will be understood by those skilled in the art that various changes in form and details may be made without departing from the spirit and scope of the invention.

What is claimed is:

1. A multifunctional toothbrush comprising (a) a handle having an elongated top covering and a bottom covering enclosing a hollow space, the edge of the bottom covering being provided with a plurality of engaging dovetail joints in combination with a plurality of mounting holes on the edge of the top covering, the enclosed hollow space including an elongated slot, a curving slot and a spring chamber and a partition wall having a notch being formed in between the spring chamber and the curving slot, the surface of the top covering at the position corresponding to the spring chamber being provided with a plurality of water-discharging holes;

(b) a bristles seat, having a top housing seat and a bottom housing seat, the housing seats individually having a head portion, and an extension portion, a plurality of dovetail joints being provided on the top surface of the bottom housing seat to combine with a plurality of mounting holes on the bottom surface of the top housing seat, a plurality of fixed bristles being mounted on the top surface of the top housing seat along the edge thereof, a circular hole and a rectangular opening being provided adjacent to each other on the surface of the top housing seat, wherein the top end of the bottom housing seat is provided with a peg mounting hole in alignment with the circular hole at the head portion of the top housing seat, and a cylindrical recess is in alignment with the rectangular opening on the top housing seat, at one edge of the cylindrical recess, adjacent to the extension portion, a semi-circular slot is provided, and along the extension portion, an elongated semi-circular slot is extended until the end thereof;

(c) an actuating rod being an elongated rod having a small shaft having a protrusion mounted vertically to the small shaft, at the top end thereof, a cylindrical shaft of larger diameter being mounted vertically with a row of bristles, and a vertical cross-shaped member being provided onto the rod, close to the rear end of the actuating rod, and the rear end of the rod being provided with a circular blocking disc;

(d) a teeth-polishing disc having a plurality of tiny particle on the surface thereof, and the center, at the bottom surface of the disc being provided with a polygonal hole with a plurality of vertical slots at the external edge thereof;

(e) a positioning peg having the head portion being fabricated into a polygonal head; and (f) a spring located within the spring chamber, thereby, while brushing the teeth, the hand holds the handle and when the handle is pushed towards the bristles seat, the cross-shaped member on the actuating rod moves along the curving slot, which causes the protrusion at the tip of the actuating rod to move simultaneous with the movement of the actuating rod and drives the polishing disc, and when the bristles seat and the actuating rod retract back into the handle until the blocking disc compresses the spring, the spring force of the spring cause the actuating rod and the cross-shaped member to move towards the bristles seat along the curving slot again, thus, the polishing disc rotates to polish the teeth.

* * * * *